US005366509A

United States Patent [19]

Ota et al.

[11] Patent Number: 5,366,509

[45] Date of Patent: Nov. 22, 1994

[54] METHOD FOR BLEACHING CLOTHS

[75] Inventors: Masanori Ota; Masashi Nakamura, both of Chiba; Takashi Kamiyama, Tokyo, all of Japan

[73] Assignee: Nissan Chemical Industries, Ltd., Tokyo, Japan

[21] Appl. No.: 989,880

[22] Filed: Dec. 11, 1992

Related U.S. Application Data

[63] Continuation of Ser. No. 537,829, Jun. 14, 1990, abandoned.

[30] Foreign Application Priority Data

Jun. 19, 1989 [JP] Japan ..... 1-156080

[51] Int. Cl.[5] ..... D06L 3/06

[52] U.S. Cl. ..... 8/108.1; 8/111; 8/109; 8/102; 252/94; 252/95

[58] Field of Search ..... 8/108.1, 111, 109, 102; 252/94, 95

[56] References Cited

U.S. PATENT DOCUMENTS

| | | | |
|---|---|---|---|
| 3,431,206 | 3/1969 | Hilton et al. | 252/99 |
| 3,706,670 | 12/1972 | Gray | 252/95 |
| 3,769,224 | 10/1973 | Inamoroto | 252/95 |
| 4,076,653 | 2/1978 | Davies et al. | 252/532 |
| 4,193,888 | 3/1980 | McHugh | 252/99 |
| 4,196,103 | 4/1980 | Richter | 252/540 |
| 4,218,220 | 8/1980 | Kappler et al. | 8/102 |
| 4,252,664 | 2/1981 | Inamoroto | 252/116 |
| 4,409,117 | 10/1983 | Holmberg et al. | 252/99 |
| 4,588,409 | 5/1986 | Sercus | 8/403 |

FOREIGN PATENT DOCUMENTS

| | | |
|---|---|---|
| 62463/73 | 5/1975 | Australia . |
| 0275432A1 | 7/1988 | European Pat. Off. . |

OTHER PUBLICATIONS

Chemical Abstracts 108(20):169119e, "Method for efficiently removing lignin from cotton fibrous materials", Csiszar et al, Aug. 28, 1987.

Chemical Abstracts 107(18):156210g, "Optimization of a low-temp. combined scouring and bleaching process . . . ", Venkatraj et al, 1987.

Chemical Abstracts 104(22):188061p, "Treatment of bleached cellulosic materials . . . ", Kalaus et al, 1985.

Chemical Abstracts 104(20):170076n, "Bleaching fibers", Isa et al, Oct. 29, 1985.

Chemical Abstracts 104(16):131420a, "Bleaching fibers", Isa et al, Oct. 29, 1985.

Chemical Abstracts 102(4):26210t, "Improvement of washing of fabrics from synthetic fibers", Burinskaya et al, 1984.

Chemical Abstracts 101(8):56379b, "Production and use of antimicrobial synthetic fibers . . . ", Vainburg et al, 1984.

Chemical Abstracts 95(26):221269h, "Low temperature bleaching", Davis et al, Aug. 20, 1981.

Chemical Abstracts 94(6):32124a, "Bleaching of textiles", Japan Carlit Co., Ltd, Mar. 9, 1979.

Chemical Abstracts 92(8):60239u, "Bleaching of textiles woven from polyacrylonitrile fibers", Bel'tsov et al, 1979.

Chemical Abstracts 89(20):165328p, "Encapsulation process", Alterman et al, May 4, 1978.

Chemical Abstracts 85(16):109941p, "Improved method for bleaching linen fabrics", Bel'tsov et al, 1976.

Chemical Abstracts 85(16):109942q, "Study of bleaching linen fabrics with sodium dichloroisocyanurate", Bel'tsov et al, 1975.

(List continued on next page.)

*Primary Examiner*—Johann Richter
*Assistant Examiner*—Catherine S. Kilby Scalzo
*Attorney, Agent, or Firm*—Oliff & Berridge

[57] ABSTRACT

A method for bleaching a cloth dyed with an indigo dye by using a processing solution containing a bleaching agent, wherein said processing solution is an aqueous solution of a dichloroisocyanuric acid salt, is disclosed. According to the invention, the degree of bleaching can be easily controlled and, after the bleaching, neither yellowing nor deterioration of fibers occurs.

18 Claims, No Drawings

OTHER PUBLICATIONS

Chemical Abstracts 85(10):64612p, "Improvement in the bleaching process for textile fibers", Bel'tsov et al, 1974.

Chemical Abstracts 84(22):152636j, "Detergent composition containing coated bleach particles", Alterman et al, Mar. 16, 1976.

Chemical Abstracts 83(18):148906j, "Bleaching fabrics made with poly(vinyl alcohol) fibers . . . ", Bel'tsov et al, 1975.

Chemical Abstracts 82(20):126470q, "Effect of sodium dichloroisocyanurate bleaching solutions . . . ", Burinskaya et al, 1974.

Chemical Abstracts 82(10):60527e "Composition for washing textiles", Diez Alcaine et al, Jul. 5, 1974.

Chemical Abstracts 82(8):44830t, "Bleaching textile fibers with chlorinated isocyanuric acid derivatives", Burinskaya et al, 1974.

Chemical Abstracts 78(14):85756j, "Effect of isocyanuric chloro-derivatives on cotton fibers . . . ", Bel'tsov et al, 1971.

Chemical Abstracts 76(8):35458b, "Bleaching compositions containing a fluorescent whitener", Colgate-Palmolive, Aug. 11, 1971.

Chemical Abstracts 72(26):134000v, "Use of chloro-derivatives of isocyanuric acid for fiber bleaching", Bel'tsov et al, 1970.

Chemical Abstracts 72(18):901442w, "Bleaching bast fibers with cyanuryl chloride", Office National Industriel de l'Azote, Feb. 18, 1970.

Chemical Abstracts 72(24):114468e, "Whitening compositions", Pashkov et al, 1969.

Chemical Abstracts 70(22):97924k, "Bleaching of textiles with alkali metal chlorites", Grunow, Mar. 15, 1968.

Chemical Abstracts 70(20):88774j, "Bleaching treated textiles with chlorocyanurates", Hilton et al, Mar. 4, 1969.

Chemical Abstracts 70(10)38789x, "Bleaching of textiles by chlorocyanuric derivatives", Lhoste et al, 1967.

METHOD FOR BLEACHING CLOTHS

This is a continuation of application Ser. No. 07/537,829 filed Jun. 14, 1990, now abandoned.

FIELD OF THE INVENTION

The present invention relates to a method for bleaching a cloth dyed with an indigo dye and more particularly, to a method for bleaching a cloth dyed with an indigo dye, such as a denim, by using an aqueous solution comprising a dichloroisocyanuric acid alone or as a main component.

BACKGROUND OF THE INVENTION

In recent years, cloths dyed with an indigo dye, particularly a bleached denim comprising a blue denim having been subjected to bleaching processing, have become popular.

Bleaching of a blue denim includes a case where a blue denim is relatively uniformly bleached and a case where a blue denim is non-uniformly bleached. Usually, in the case where a blue denim is relatively uniformly bleached, dip bleaching is carried out by using sodium hypochlorite. In the case where a blue denim is non-uniformly bleached, bleaching is carried out by impregnating a pumice or the like with a sodium hypochlorite solution and, after drying, revolving and stirring a blue denim in a cleaning device. In any of these cases, sodium hypochlorite is mainly used as a bleaching agent. As other bleaching agents than sodium hypochlorite, U.S. Pat. No. 4,218,220 proposes use of trichloroisocyanuric acid as a bleaching agent.

In any of these methods, a step for removing chlorine by using a reducing agent such as sodium thiosulfate is introduced after the bleaching processing step.

The above-described case of using sodium hypochlorite as a bleaching agent involves such a defect that cotton fibers are deteriorated and, hence, when the degree of bleaching is further controlled, a method for controlling an available chlorine concentration of or processing time with a processing solution is employed. However, in this case, the bleaching power of sodium hypochlorite is so strong that it is not easy to control the degree of bleaching. Further, as a method for controlling the degree of bleaching, a method for changing a pH of or processing time with a processing solution could be considered, but this method is not desired because the pH of the sodium hypochlorite solution is lowered, or if the temperature of the processing solution is increased, a chlorine gas is volatilized.

In order to solve this problem, U.S. Pat. No. 4,218,220 proposes use of trichloroisocyanuric acid as a bleaching agent. However, trichloroisocyanuric acid is considerably acidic such that a 0.1% aqueous solution thereof has a pH of from 1 to 2, and its bleaching power is too high. Further, in the case that it is aimed to suppress the bleaching power of trichloroisocyanuric acid by adding an alkaline agent thereto, there are still such problems that not only is it dangerous because decomposition of trichloroisocyanuric acid causes generation of nitrogen chloride, but a blue denim is likely yellowed.

Bleaching of a blue denim is likely delicately influenced by not only the type of a bleaching agent used but the processing condition employed. Therefore, undesired phenomena such as deterioration of fibers by reduction in the tear strength and yellowing of the blue denim sometimes occur.

SUMMARY OF THE INVENTION

The present inventors have found that the above-described problems can be solved by using dichloroisocyanuric acid and then accomplished the present invention.

An object of the present invention is to provide a method for bleaching a cloth dyed with an indigo dye, in which the degree of bleaching can be easily controlled and, after bleaching, neither yellowing nor deterioration of fibers occurs.

That is, the present invention relates to a method for bleaching a cloth dyed with an indigo dye, which comprises using, as a processing solution, an aqueous solution of a dichloroisocyanuric acid salt which is optionally compounded with a basic compound and/or a surfactant.

DETAILED DESCRIPTION OF THE INVENTION

The cloth dyed with an indigo dye, which is used in the method of the present invention, is not particularly limited, but the method of the present invention is particularly effective for a denim. Besides, the method of the present invention is also applicable to traditional products such as knitwear, yukata, and pongee as well as handicraft products such as shop curtain and tablecloth.

As the dichloroisocyanuric acid salt, sodium dichloroisocyanurate and/or potassium dichloroisocyanurate is preferred. A suitable concentration of the dichloroisocyanuric acid salt in the processing solution is from 0.05 to 1.5% by weight, preferably from 0.1 to 1.0% by weight, in terms of the available chlorine concentration.

In the range of the available chlorine concentration of 0.5% by weight or more, since a processing solution comprising an aqueous solution containing only a dichloroisocyanuric acid salt tends to cause problems such as yellowing of fibers after bleaching processing, in order to prevent such problems, it is preferred to compound therewith at least one member selected from basic compounds, anionic surfactants, and nonionic surfactants.

Even in the range of the available chlorine concentration of less than 0.5% by weight, it is, as a matter of course, possible to use the above-described basic compounds and/or surfactants, use of which is rather preferred.

Examples of basic compounds which can be used in the present invention include basic inorganic compounds such as sodium carbonate, sodium metasilicate, and trisodium phosphate and basic organic salt compounds such as sodium citrate.

A suitable amount of the basic compound added is adjusted such that the processing solution has a pH of from 5 to 11 and preferably from 6 to 10. If the pH exceeds 11, not only the bleaching effect is lowered, but reduction in the strength of fiber occurs. On the other hand, if the pH is less than 5, yellowing likely occurs.

Examples of anionic surfactants which can be used in the present invention include alkylbenzenesulfonic acid salts, alkanesulfonic acid salts, α-olefin-sulfonic acid salts, and alkyl sulfate polyoxyethylene salts.

Examples of nonionic surfactants which can be used in the present invention include alkyl polyoxyethylene ethers and alkylphenyl polyoxyethylene ethers.

A suitable amount of the surfactant compounded is from 0.01 to 0.2% by weight in the processing solution. If the amount is less than 0.01% by weight, the yellowing-preventing effect is not satisfactory, whereas if it exceeds 0.2% by weight, a rinsing operation in the subsequent step becomes likely insufficient.

In the method of the present invention, the dichloroisocyanuric acid salt can be used in combination with a cationic surfactant. In this case, a concentration of the dichloroisocyanuric acid salt in the aqueous solution is from 0.05 to 0.4% by weight, preferably from 0.1 to 0.2% by weight, in terms of the available chlorine concentration.

As will be clear from the Examples as described later, in the case that a cloth is treated with a processing solution containing sodium dichloroisocyanurate in an effective chlorine concentration of about 0.2% by weight and 0.02% by weight of lauryldimethylbenzylammonium chloride as a cationic surfactant, a bleaching effect of the cloth which is substantially equal to that attained in the case that a cloth is treated with a processing solution containing only sodium dichloroisocyanurate in an effective chlorine concentration of about 0.4% by weight can be attained. That is, the cationic surfactant functions as a filler for the bleaching agent.

A suitable amount of the cationic surfactant is from 0.005 to 0.5% by weight, preferably from 0.01 to 0.05% by weight, in the aqueous solution. If the amount exceeds 0.5% by weight, a rinsing operation in the subsequent step becomes likely insufficient.

The bleaching effect of a cloth increases in substantial proportion to the amounts of the dichloroisocyanuric acid salt and cationic surfactants added. Accordingly, though it is possible to control these amounts, if the effective chlorine concentration is less than 0.05% by weight, desired results cannot be obtained even though the amount of the cationic surfactant added is increased. Further, if the effective chlorine concentration exceeds 0.4% by weight, the bleaching by combined use with the cationic surfactant markedly proceeds, whereby yellowing of the cloth so-called as "chlorine yellowing" is likely generated.

Moreover, though the cationic surfactant may be used in combination with the above-described basic compound and nonionic surfactant, it is not preferred to use the cationic surfactant in combination with the anionic surfactant.

A suitable temperature of the bleaching processing is not higher than 70° C., preferably from 30° to 70° C., and more preferably from 50° to 65° C. If the temperature is lower than 30° C., it is not efficient because it takes a long period for achieving the bleaching. If it exceeds 70° C., decomposition of chlorine is vigorous, and the bleaching is likely non-uniform. A suitable weight ratio (i.e., bath ratio) of the cloth to the processing solution is from 1:10 to 1:50 and preferably from 1:20 to 1:40. If the bath ratio exceeds 1:10, the bleaching is likely non-uniform due to twisting between the fibers. Further, a bath ratio of less than 1:50 could be employed, but it is of no efficiency. A processing time is usually from 10 to 30 minutes though it varies depending on the temperature and bath ratio.

After the bleaching processing by the method of the present invention, reduction processing, rinsing and drying steps which are carried out in the conventional bleaching step are employable. Further, a method in which the above-described bleaching solution is impregnated into a pumice or the like and local bleaching is performed is also applicable.

The present invention is described in more detail with reference to the following Examples and Comparative Examples.

EXAMPLES 1 TO 12 AND COMPARATIVE EXAMPLES 1 TO 14

Bleaching was carried out in the manner described below under the conditions as shown in Table 1, followed by evaluation. The results obtained are also shown in Table 1. For reference, the physical properties of a denim which had been subjected to a bleaching processing step with only water are shown in Table 1, too.

[Bleaching Method]

Into a 500 ml beaker, 500 ml of distilled water was charged, and a bleaching agent was added thereto under the conditions as shown in Table 1, followed by keeping the mixture at 50° C. Two blue denim cloth pieces (15 cm×8 cm in size) were dipped therein and bleached for 10 minutes by means of a detergency tester ("Tergoto Meter Model 7243" manufactured by U.S. Testing Co., Ltd.) at 100 rpm, followed by adding thereto 0.5% by weight of sodium thiosulfate to effect chlorine-removal treatment. Thereafter, the resulting cloth pieces were air dried at room temperature for 24 hours, ironed, and then evaluated with respect to the following items.

[Bleaching Effect]

The color tone of the bleached denim cloth piece was measured in terms of lightness (L) and hue (a, b) by means of a differential colorimeter (manufactured by Tokyo Denshoku K.K.), and suitability of the bleaching effect as well as degree of yellowing were visually observed. The results are shown in Table 1.

The bleaching effect is expressed by three ratings, "suitable", "excessive", and "insufficient"; and the yellowing is expressed by the following symbols.

A: not yellowed
B: slightly yellowed
C: yellowed
D: markedly yellowed

[Tear Strength]

The bleached denim cloth piece was measured with respect to tear strength under the conditions according to the single tongue method as defined in JIS L1004 by means of a Tensilon (a trade name of Toyo Boldwing Co., Ltd.).

The denim used was 14 oz., and the chemicals used are shown below.

[Bleaching Agent]
(1) sodium hypochlorite solution
(2) trichloroisocyanuric acid powder
(3) sodium dichloroisocyanurate powder
(4) sodium dichloroisocyanurate dihydrate powder
(5) potassium dichloroisocyanurate powder
(6) high test hypochlorite

[Basic Substance]
(1) sodium carbonate powder
(2) sodium metasilicate powder
(3) trisodium phosphate powder
(4) sodium citrate

[Surfactant]
Anionic Surfactant (1) sodium salt of alkyl sulfate-decaethylene oxide adduct ("Persoft-EL", a trade name of Nippon Oil and Fats Co., Ltd.)

(2) sodium alkylbenzenesulfonate ("Newrex Paste H", a trade name of Nippon Oil and Fats Co., Ltd.)

(3) sodium α-olefin-sulfonate ("Nikkol OS-14", a trade name of Nikko Chemical Co., Ltd.)

Nonionic Surfactant (1) alkyl polyoxyethylene ether ("Nonion E-215, a trade name of Nippon Oil and Fats Co., Ltd.)

(2) alkylphenyl polyoxyethylene ether ("Nonion NS-202", a trade name of Nippon Oil and Fats Co., Ltd.)

TABLE 1

| | Bleaching Condition | | | | Evaluation Result | | | | | |
|---|---|---|---|---|---|---|---|---|---|---|
| | Bleaching Agent & Available Chlorine Concentration (%) | Basic Substance (%) | Surfactant (%) | pH of Processing Solution | Tear Strength (kg) | Color Tone L | Color Tone a | Color Tone b | Bleaching Effect | Yellowing |
| Example 1 | DCCNa (0.3) | — | — | 5.8 | 4.4 | 34.2 | −0.9 | −7.8 | suitable | A |
| Example 2 | DCCNa (0.3) | sodium carbonate (0.3) | — | 9.2 | 4.5 | 43.0 | −3.1 | −8.5 | suitable | A |
| Example 3 | DCCNa (0.3) | sodium m-silicate (0.3) | — | 8.7 | 4.6 | 31.5 | −0.7 | −13.3 | suitable | A |
| Example 4 | DCCNa (0.3) | sodium citrate (0.3) | — | 7.4 | 4.4 | 35.4 | −1.6 | −10.2 | suitable | A |
| Example 5 | DCCNa (0.3) | — | α-OS—Na (0.1) | 6.1 | 4.5 | 32.9 | −0.4 | −14.4 | suitable | A |
| Example 6 | DCCNa (0.3) | sodium carbonate (0.3) | α-OS—Na (0.1) | 9.0 | 4.5 | 36.4 | −0.8 | −13.3 | suitable | A |
| Example 7 | DCCNa (0.3) | — | AS—Na (0.1) | 6.3 | 4.7 | 35.5 | −2.0 | −10.9 | suitable | A |
| Example 8 | DCCNa (0.5) | — | POE (0.2) | 6.1 | 4.5 | 46.9 | −4.1 | −9.9 | suitable | A |
| Example 9 | DCCNa (0.5) | sodium carbonate (0.5) | POE (0.2) | 9.2 | 4.5 | 54.3 | −7.6 | −0.6 | suitable | A |
| Example 10 | DCCNa.2$H_2O$ (0.3) | — | ABS—Na (0.2) | 6.2 | 4.6 | 33.1 | −0.7 | −15.5 | suitable | A |
| Example 11 | DCCK (0.3) | — | — | 6.0 | 4.5 | 33.6 | −1.4 | −8.1 | suitable | A |
| Example 12 | DCCK (0.3) | — | ABS—Na (0.2) | 6.3 | 4.7 | 34.0 | −1.8 | −11.8 | suitable | A |
| Comparative Example 1 | NaClO (0.1) | — | — | 7.6 | 4.3 | 22.5 | 1.2 | −14.9 | insufficient | A |
| Comparative Example 2 | NaClO (0.3) | — | — | 8.1 | 3.3 | 27.7 | 0.3 | −17.9 | suitable | B |
| Comparative Example 3 | NaClO (0.5) | — | — | 8.6 | 2.7 | 42.2 | −2.5 | −16.1 | suitable | C |
| Comparative Example 4 | NaClO (2.0) | — | — | 9.7 | 1.6 | 69.5 | −3.7 | 4.3 | excessive | C |
| Comparative Example 5 | high test hypochlorite (0.3) | — | — | 8.3 | 3.2 | 25.4 | 0.1 | −13.3 | suitable | C |
| Comparative Example 6 | high test hypochlorite (0.5) | — | — | 8.8 | 2.5 | 43.3 | −1.8 | −19.3 | suitable | C |
| Comparative Example 7 | TCCA (0.05) | — | — | 5.5 | 4.5 | 29.1 | −1.9 | −15.5 | insufficient | A |
| Comparative Example 8 | TCCA (0.3) | — | — | 4.3 | 4.4 | 39.0 | −0.4 | −7.7 | suitable | D |
| Comparative Example 9 | NaClO (0.3) | sodium carbonate (0.3) | — | 8.7 | 2.1 | 25.1 | 0.2 | −17.0 | suitable | C |
| Comparative Example 10 | NaClO (0.1) | — | ABS—Na (0.1) | 7.9 | 4.0 | 20.9 | 1.4 | −15.3 | insufficient | A |
| Comparative Example 11 | NaClO (0.3) | — | ABS—Na (0.1) | 8.3 | 3.4 | 27.1 | 0.4 | −13.3 | suitable | C |
| Comparative Example 12 | high test hypochlorite (0.3) | — | POE (0.2) | 8.2 | 2.6 | 23.1 | −0.2 | −15.8 | suitable | A |
| Comparative Example 13 | TCCA (0.3) | trisodium phosphate (0.3) | — | 5.7 | 4.0 | 36.1 | −0.3 | −10.9 | suitable | B |
| Comparative | TCCA (0.3) | trisodium | ABS—Na (0.1) | 5.7 | 4.0 | 34.8 | −0.2 | −13.3 | suitable | B |

TABLE 1-continued

| | Bleaching Condition | | | | Evaluation Result | | | | | |
|---|---|---|---|---|---|---|---|---|---|---|
| | Bleaching Agent & Available Chlorine Concentration (%) | Basic Substance (%) | Surfactant (%) | pH of Processing Solution | Tear Strength (kg) | Color Tone L | Color Tone a | Color Tone b | Bleaching Effect | Yellowing |
| Example 14 | | phosphate (0.3) | | | | | | | | |
| Reference Example | — | — | — | 7.4 | 4.5 | 18.3 | −8.2 | −10.2 | — | — |

DCCNa: sodium dichloroisocyanurate
DCCNa.$2H_2O$: sodium dichloroisocyanurate dihydrate
DCCK: potassium dichloroisocyanurate
α-OS—Na: sodium α-olefin-sulfonate
AS—Na: alkyl sulfate 10EONa salt
POE: polyoxyethylene alkyl ether
ABS—Na: sodium alkylbenzenesulfonate
TCCA: trichloroisocyanuric acid

EXAMPLES 13 TO 29 AND COMPARATIVE EXAMPLES 15 TO 18

Bleaching was carried out in the manner described below under the conditions as shown in Table 2, followed by evaluation. The results obtained are also shown in Table 2.

[Bleaching Method and Evaluation Method]

Five liters of warm water at 50° C. was charged in a small-sized electric washing machine, and a bleaching agent was added thereto under the conditions as shown in Table 2. One blue denim cloth piece (30 cm×45 cm in size) was thrown into this processing solution and bleached for 30 minutes, followed by subjecting to a chlorine-removal treatment with 5 liters of warm water having 20 g of sodium thiosulfate added thereto for 15 minutes. The resulting cloth piece was rinsed with tap water for 15 minutes, air dried at room temperature for 24 hours, and then ironed. The color tone of the bleached denim cloth piece was measured in terms of lightness (L) and hue (a, b) by means of the same differential colorimeter as used in Example 1.

The denim used was the same type as in Example 1, and the cationic surfactant used is as follows.

(1) hexadecyltrimethylammonium chloride
(2) stearyltrimethylammonium chloride
(3) lauryldimethylbenzylammonium chloride
(4) stearyldimethylbenzylammonium chloride

TABLE 2

| | Bleaching Condition | | Evaluation Result Color Tone | | |
|---|---|---|---|---|---|
| | Bleaching Agent & Available Chlorine Concentration (%) | Cationic Surfactant (%) | L | a | b |
| Example 13 | DCCNa (0.06) | lauryldimethyl-benzylammonium chloride (0.01) | 19.7 | 1.9 | −13.7 |
| Example 14 | DCCNa (0.06) | lauryldimethyl-benzylammonium chloride (0.02) | 21.5 | 1.9 | −15.7 |
| Example 15 | DCCNa (0.06) | lauryldimethyl-benzylammonium chloride (0.03) | 28.9 | 0.4 | −17.0 |
| Example 16 | DCCNa (0.18) | lauryldimethyl-benzylammonium chloride (0.01) | 57.5 | −2.6 | −8.7 |
| Example 17 | DCCNa (0.18) | lauryldimethyl-benzylammonium chloride (0.02) | 64.8 | −2.6 | −3.2 |
| Example 18 | DCCNa (0.18) | lauryldimethyl-benzylammonium chloride (0.03) | 75.2 | −2.1 | 4.0 |
| Example 19 | DCCNa (0.27) | lauryldimethyl-benzylammonium chloride (0.01) | 66.9 | −2.6 | −1.2 |
| Example 20 | DCCNa (0.27) | lauryldimethyl-benzylammonium chloride (0.02) | 70.2 | −2.7 | −1.9 |
| Example 21 | DCCNa (0.27) | lauryldimethyl-benzylammonium chloride (0.03) | 71.5 | −2.6 | 1.0 |
| Example 22 | DCCNa (0.36) | lauryldimethyl-benzylammonium chloride (0.01) | 75.1 | −2.3 | 2.9 |
| Example 23 | DCCNa (0.36) | lauryldimethyl-benzylammonium chloride (0.02) | 78.7 | −2.1 | 4.8 |
| Example 24 | DCCNa (0.36) | lauryldimethyl-benzylammonium chloride (0.03) | 74.9 | −2.2 | 4.7 |
| Example 25 | DCCK (0.18) | lauryldimethyl-benzylammonium chloride (0.02) | 63.3 | −2.4 | −3.1 |
| Example 26 | DCCNa (0.06) | hexadecyltrimethyl-ammonium chloride (0.02) | 68.6 | −2.6 | −3.9 |
| Example 27 | DCCNa (0.06) | stearyltrimethyl-ammonium chloride (0.02) | 56.5 | −3.1 | −5.1 |
| Example 28 | DCCNa (0.06) | lauryldimethyl-benzylammonium chloride (0.02) | 67.3 | −2.4 | −1.7 |
| Example 29 | DCCNa (0.06) | stearyldimethyl-benzylammonium chloride (0.02) | 52.3 | −2.7 | −9.0 |
| Comparative Example 15 | DCCNa (0.18) | — | 42.0 | −1.3 | −17.2 |
| Comparative Example 16 | DCCNa (0.27) | — | 55.2 | −2.6 | −12.9 |
| Comparative Example 17 | DCCNa (0.36) | — | 65.9 | −2.9 | −6.4 |
| Comparative | DCCK (0.18) | — | 39.8 | −1.3 | −17.7 |

TABLE 2-continued

| | Bleaching Condition | | Evaluation Result Color Tone | | |
|---|---|---|---|---|---|
| | Bleaching Agent & Available Chlorine Concentration (%) | Cationic Surfactant (%) | L | a | b |
| Example 18 | | | | | |

While the invention has been described in detail and with reference to specific embodiments thereof, it will be apparent to one skilled in the art that various changes and modifications can be made therein without departing from the spirit and scope thereof.

What is claimed is:

1. A method of bleaching a denim dyed with an indigo dye by using a processing solution containing a single bleaching agent and a cationic surfactant, wherein said processing solution is an aqueous solution, said bleaching agent consists of dichloroisocyanuric acid salt in a concentration of from 0.05 to 0.4% by processing solution, in terms of available chlorine, and said cationic surfactant is present in a concentration of from 0.005 to 0.5% by weight of said processing solution.

2. A method as claimed in claim 1, wherein said dichloroisocyanuric acid salt is selected from the group consisting of sodium dichloroisocyanurate and potassium dichloroisocyanurate.

3. A method for bleaching a denim dyed with an indigo dye by using a processing solution containing bleaching agents, wherein said processing solution is an aqueous solution of a dichloroisocyanuric acid salt and is compounded with at least one member selected from the group consisting of a basic compound, an anionic surfactant, and a nonionic surfactant, and the processing solution has a pH value approximately from 5 to 11 and a concentration of available chlorine approximately from 0.1 to 1.0% by weight.

4. A method as claimed in claim 3, wherein said dichloroisocyanuric acid salt is selected from the group consisting of sodium dichloroisocyanurate and potassium dichloroisocyanurate.

5. A method as claimed in claim 3, wherein said basic compound is at least one compound selected from the group consisting of sodium carbonate, sodium metasilicate, trisodium phosphate, and sodium citrate.

6. A method as claimed in claim 3, wherein said anionic surfactant is at least one anionic surfactant selected from the group consisting of an alkylbenzenesulfonic acid salt, an alkanesulfonic acid salt, an $\alpha$-olefin-sulfonic acid salt, and an alkyl sulfate polyoxyethylene salt.

7. A method as claimed in claim 3, wherein said nonionic surfactant is at least one nonionic surfactant selected from the group consisting of an alkyl polyoxyethylene ether and an alkylphenyl polyoxyethylene ether.

8. A method for bleaching a denim dyed with an indigo dye by using a processing solution containing a single bleaching agent, wherein said processing solution is an aqueous solution of a dichloroisocyanuric acid salt and a cationic surfactant, the processing solution having a pH value of approximately 5 to 11 and a concentration of available chlorine approximately from 0.1 to 0.4% by weight.

9. A method as claimed in claim 1, wherein said method further comprises adding to the processing solution a basic substance selected from the group consisting of sodium carbonate powder, sodium metasilicate powder, trisodium phosphate powder and sodium citrate.

10. The method of claim 1, wherein the processing solution has an available chlorine concentration of from 0.1 to 0.2% by weight.

11. The method of claim 1, wherein the processing solution is applied for a processing time of about 10 to 30 minutes.

12. The method of claim 6, wherein the processing solution is applied for a processing time of about 10 to 30 minutes.

13. The method of claim 1, wherein the processing solution is applied at a temperature of about 30° C. to 70° C.

14. The method of claim 3, wherein the processing solution is applied at a temperature of about 30° C. to 70° C.

15. The method of claim 1, wherein a weight ratio of the denim to the processing solution is about from 1:10 to about 1:50.

16. The method of claim 3, wherein a weight ratio of the denim to the processing solution is about from 1:10 to about 1:50.

17. A method as claimed in claim 8, wherein a dichloroisocyanuric acid salt is selected from the group consisting of potassium dichloroisocyanurate and the potassium dichlorocyanurate.

18. A method as in claimed in claim 8, wherein the cationic surfactant is at least one cationic surfactant selected from an alkyltrimethylammonium chloride and an alkyldimethyl-benzylammonium chloride.

* * * * *